US008461955B2

(12) United States Patent
Yokota

(10) Patent No.: US 8,461,955 B2
(45) Date of Patent: Jun. 11, 2013

(54) REACTOR AND REACTOR MANUFACTURING METHOD

(75) Inventor: Shuji Yokota, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/574,758

(22) PCT Filed: Jun. 22, 2010

(86) PCT No.: PCT/JP2010/060568

§ 371 (c)(1),
(2), (4) Date: Jul. 23, 2012

(87) PCT Pub. No.: WO2011/161770

PCT Pub. Date: Dec. 29, 2011

(65) Prior Publication Data

US 2012/0299685 A1 Nov. 29, 2012

(51) Int. Cl.

| | |
|---|---|
| ***H01F 27/24*** | (2006.01) |
| ***H01F 21/10*** | (2006.01) |
| ***H01F 17/06*** | (2006.01) |
| ***H01F 27/30*** | (2006.01) |
| ***H01F 7/06*** | (2006.01) |

(52) U.S. Cl.
USPC ..... 336/212; 336/90; 336/178; 336/221; 336/233; 336/208; 29/602.1

(58) Field of Classification Search
USPC ..... 336/212, 90–96, 178, 221, 233, 208; 29/602.1, 605, 606
See application file for complete search history.

(56) References Cited

U.S. PATENT DOCUMENTS

| | | | | |
|---|---|---|---|---|
| 2,494,579 | A * | 1/1950 | Dawson et al. | 336/73 |
| 3,189,987 | A * | 6/1965 | Paterson | 29/416 |
| 3,480,896 | A * | 11/1969 | Neuman | 336/83 |
| 3,671,759 | A * | 6/1972 | Dopheide | 379/378 |
| 4,149,133 | A * | 4/1979 | Hilgert | 336/30 |
| 4,321,572 | A * | 3/1982 | Studer et al. | 336/83 |

(Continued)

FOREIGN PATENT DOCUMENTS

| | | | |
|---|---|---|---|
| JP | 1-287907 | A | 11/1989 |
| JP | 06-089819 | A | 3/1994 |

(Continued)

OTHER PUBLICATIONS

International Search Report of PCT/JP2010/060568 mailed Oct. 5, 2010.

*Primary Examiner* — Mohamad Musleh
*Assistant Examiner* — Mangtin Lian
(74) *Attorney, Agent, or Firm* — Kenyon & Kenyon LLP

(57) ABSTRACT

A reactor has a cylindrical molded coil assembly formed by covering a coil with a resin, wherein the coil assembly is sealed by an iron powder mixed resin to which iron powder has been admixed. The reactor has an axial core shaft, and single or multiple ring-shaped core members. The ring-shaped core members are disposed outside the outer surface of the core shaft such that the core shaft is inserted inside the inner surface of said ring-shaped core members, and the coil assembly is disposed outside the outer surface of the ring-shaped core member such that the ring-shaped core members are inserted inside the inner surface of said coil assembly. A protrusion protruding inwards from the inner surface of the coil assembly contacts the axial end surface of a ring-shaped core member.

20 Claims, 12 Drawing Sheets

U.S. PATENT DOCUMENTS

| | | | | |
|---|---|---|---|---|
| 4,866,409 | A * | 9/1989 | Umezaki | 336/96 |
| 6,483,218 | B1 * | 11/2002 | Petrinko | 310/112 |
| 2001/0030594 | A1 | 10/2001 | Abe et al. | |
| 2007/0052510 | A1 * | 3/2007 | Saegusa et al. | 336/92 |
| 2012/0200382 | A1 * | 8/2012 | Hejny | 336/212 |

FOREIGN PATENT DOCUMENTS

| | | | |
|---|---|---|---|
| JP | 08-031383 | A | 3/1996 |
| JP | 08-321423 | A | 12/1996 |
| JP | 2002-203729 | A | 7/2002 |
| JP | 2003-506855 | A | 2/2003 |
| JP | 2006-352021 | A | 12/2006 |
| JP | 2007-067090 | A | 3/2007 |
| JP | 2008-021948 | A | 1/2008 |
| JP | 2008-130964 | A | 6/2008 |
| JP | 2008-182161 | A | 8/2008 |
| JP | 2009-246221 | A | 10/2009 |
| JP | 2009-259985 | A | 11/2009 |
| JP | 2009-259986 | A | 11/2009 |
| JP | 2010-027692 | A | 2/2010 |
| JP | 2010-165799 | A | 7/2010 |
| JP | 2010-165800 | A | 7/2010 |
| JP | 2010-165858 | A | 7/2010 |
| WO | 2011/161769 | A1 | 12/2011 |

* cited by examiner

REACTOR AND REACTOR MANUFACTURING METHOD

CROSS-REFERENCE TO RELATED APPLICATIONS

This is a 371 national phase application of PCT/JP2010/060568 filed on 22 Jun. 2010, the entire contents of which are incorporated herein by reference.

TECHNICAL FIELD

The present invention relates to a reactor used for example in a booster circuit of a motor drive device, and a method of manufacturing the reactor.

BACKGROUND ART

Reactors are known that are used in booster circuits of motor drive devices of electric vehicles or hybrid electric vehicles. The reactor changes voltage using inductive reactance and is made with a core and a coil. The reactor is used as a part integrated in a switching circuit, and it is repeatedly switched on and off, storing energy in the coil when switched on and creating a counter electromotive force when switched off, thereby outputting a high voltage.

Patent Literature 1 discloses a technique for a reactor comprising a coil molded with an iron-resin composite containing iron powder. With this reactor, the iron-resin composite used for molding the coil functions as the core.

CITATION LIST

Patent Literature

[Patent Literature 1] JP 2006-352021A

SUMMARY OF INVENTION

Technical Problem

However, with the technique of Patent Literature 1, the iron content of the iron-resin composite is low so that the core has a low magnetic permeability. To achieve a necessary inductance, the volume of the iron-resin composite needs to be made large to increase the cross-sectional area of the core. This results in a large outer shape of the reactor.

One possibility is to adjust the number of windings of the coil and the volume of the iron-resin composite to adjust the inductance. However, when the reactor is to be mounted within a limited area of, for example, a booster circuit of a motor drive device, there are limitations on the number of windings of the coil or the volume of the iron-resin composite, because of which there may be a case where the inductance cannot be adjusted to a necessary level. This means that the reactor cannot be provided with characteristics that keep the inductance changes sufficiently small irrespective of large current changes, i.e., stable DC superimposition characteristics showing a substantially constant (flat) inductance within the range of current being used. That is, the reactor has poor performance.

The material cost of the iron-resin composite is high, and the composite requires a long time to set. Therefore, a large amount of filling iron-resin composite leads to a higher production cost of the reactor.

Moreover, the coil is prone to come off of a predetermined position unless the coil is retained by some means when the inside of the case is filled with the iron-resin composite as in the technique of Patent Literature 1, which causes a reduction in the productivity of the reactor.

The applicants have proposed an invention relating to a reactor structure and a method of manufacturing the reactor in a PCT patent application No. PCT/JP2010/060561. However, according to this invention, a coil assembly and a bobbin need to be assembled separately. Accordingly, the applicants propose an invention below that enables a further reduction in the number of components for further reducing the production cost.

Accordingly, an object of the present invention is to provide a reactor and a reactor manufacturing method, with which the number of components can be reduced, whereby the production cost can be reduced.

Solution to Problem

One aspect of the present invention to solve the above-described problems is a reactor including a cylindrical coil assembly formed to have a coil covered with resin, an iron-resin composite containing iron powder sealing the coil assembly, wherein the reactor comprises a core shaft and one or a plurality of ring-shaped core members, the ring-shaped core member or members are provided outside an outer peripheral surface of the core shaft such that the core shaft is inserted inside an inner peripheral surface of the ring-shaped core member or members, the coil assembly is provided outside an outer peripheral surface of the ring-shaped core member or members such that the ring-shaped core member or members are inserted inside an inner peripheral surface of the coil assembly, and the coil assembly includes a protrusion protruding inwards from the inner peripheral surface and being in contact with an end face in an axial direction of the ring-shaped core member or members.

According to this aspect, the protrusion protruding inwards from the inner peripheral surface of the coil assembly is in contact with an end face in the axial direction of the ring-shaped core member. This determines the relative positions in the axial direction of the ring-shaped core member and the coil assembly. Therefore, there is no need to use a separate component to determine the relative positions in the axial direction of the ring-shaped core member and the coil assembly. Accordingly, the number of components can be reduced, and a reduction in production cost can be achieved.

In the aspect described above, a non-magnetic ring-shaped gap plate is preferably provided between adjacent ones of the ring-shaped core members.

According to this aspect, since the non-magnetic gap plate is inserted between the adjacent ring-shaped core members, the distance between the ring-shaped core members can be maintained. Therefore, the magnetic performance is improved, as magnetic flux density saturation is prevented when a large current is applied to the coil. The inductance can be adjusted easily by adjusting the thickness of the gap plate.

In the aspect described above, the protrusion is preferably provided between adjacent ones of the ring-shaped core members.

According to this aspect, the number of non-magnetic components such as the gap plate provided between the ring-shaped core members can be reduced, or omitted, so that the production cost can be reduced.

The aspect described above preferably includes an open-end case having an end face and a side wall provided extending vertically from a peripheral edge of the end face, and the core shaft preferably is formed integrally with the case on the inner side of the end face.

According to this aspect, the core shaft is formed integrally with the case. This allows adjustment of the positions in the radial direction of the ring-shaped core member and the coil assembly relative to the case.

In the aspect described above, the core shaft is preferably formed integrally with the protrusion.

According to this aspect, since the core shaft is formed integrally with the protrusion, a component such as the case supporting the core shaft is unnecessary, whereby the production cost can be reduced. Since the core shaft is integrally formed with the protrusion, the relative positions of the core shaft and the coil assembly are determined in both axial and radial directions.

In the aspect described above, the protrusion is preferably formed at an end portion in the axial direction of the coil assembly.

According to this aspect, the protrusion formed at the end portion in the axial direction of the coil assembly reliably determines the relative positions in the axial direction of the ring-shaped core member and the coil assembly.

In the aspect described above, the core shaft is preferably hollow.

According to this aspect, a cooling fluid can be supplied to the hollow part of the core shaft, leading to better cooling performance.

Another aspect of the present invention to solve the above-described problems is a method of manufacturing a reactor including a cylindrical coil assembly formed to have a coil covered with resin, an iron-resin composite containing iron powder sealing the coil assembly, wherein the reactor comprises a core shaft and one or a plurality of ring-shaped core members, the method includes the steps of: placing the ring-shaped core member or members outside an outer peripheral surface of the core shaft such that the core shaft is inserted inside an inner peripheral surface of the ring-shaped core member or members; placing the coil assembly outside an outer peripheral surface of the ring-shaped core member or members such that the ring-shaped core member or members are inserted inside an inner peripheral surface of the coil assembly; and bringing a protrusion protruding inwards from the inner peripheral surface of the coil assembly into contact with an end face in an axial direction of the ring-shaped core member or members.

According to this aspect, the protrusion protruding inwards from the inner peripheral surface of the coil assembly is brought into contact with the end face in the axial direction of the ring-shaped core member. This determines the relative positions in the axial direction of the ring-shaped core member and the coil assembly. Therefore, there is no need to use a component dedicated to determine the relative positions in the axial direction of the ring-shaped core member and the coil assembly. Accordingly, the number of components can be reduced, and a reduction in production cost can be achieved.

Advantageous Effects of Invention

Reactor and reactor manufacturing method according to the present invention can achieve reduction of the number of components and the production cost can be reduced.

DESCRIPTION OF EMBODIMENTS

Embodiments of the present invention will be hereinafter described in detail with reference to the accompanying drawings.

The reactor according to this embodiment is mounted in a drive control system of a hybrid electric vehicle for the purpose of boosting a battery voltage to a level applied to a motor generator.

Therefore, the structure of the drive control system will be described first, after which the reactor according to this embodiment will be described.

First, the drive control system will be described referring to FIG. 1 and FIG. 2.

Figure 1:
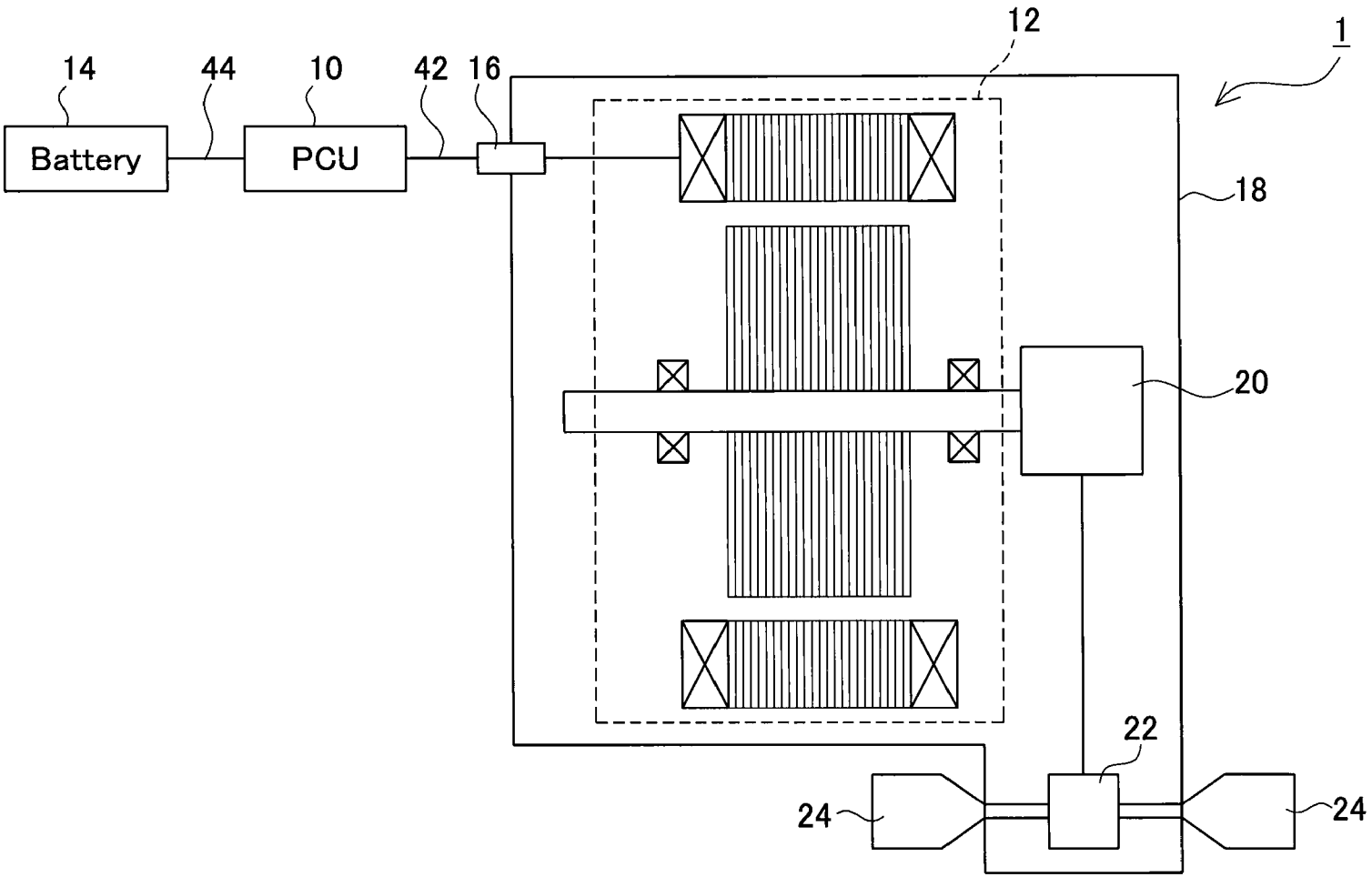
FIG. 1 is a schematic diagram showing one example of a drive control system configuration including a reactor according to the present embodiment.

FIG. 1 is a schematic diagram illustrating one example of a drive control system configuration including the reactor according to this embodiment. FIG. 2 is a circuit diagram illustrating major parts of PCU in FIG. 1.

The drive control system 1 is formed by a PCU (Power Control Unit) 10, a motor generator 12, a battery 14, a terminal base 16, a housing 18, a reduction gear 20, a differential gear 22, drive shaft receiving parts 24, and others as shown in FIG. 1.

Figure 2:
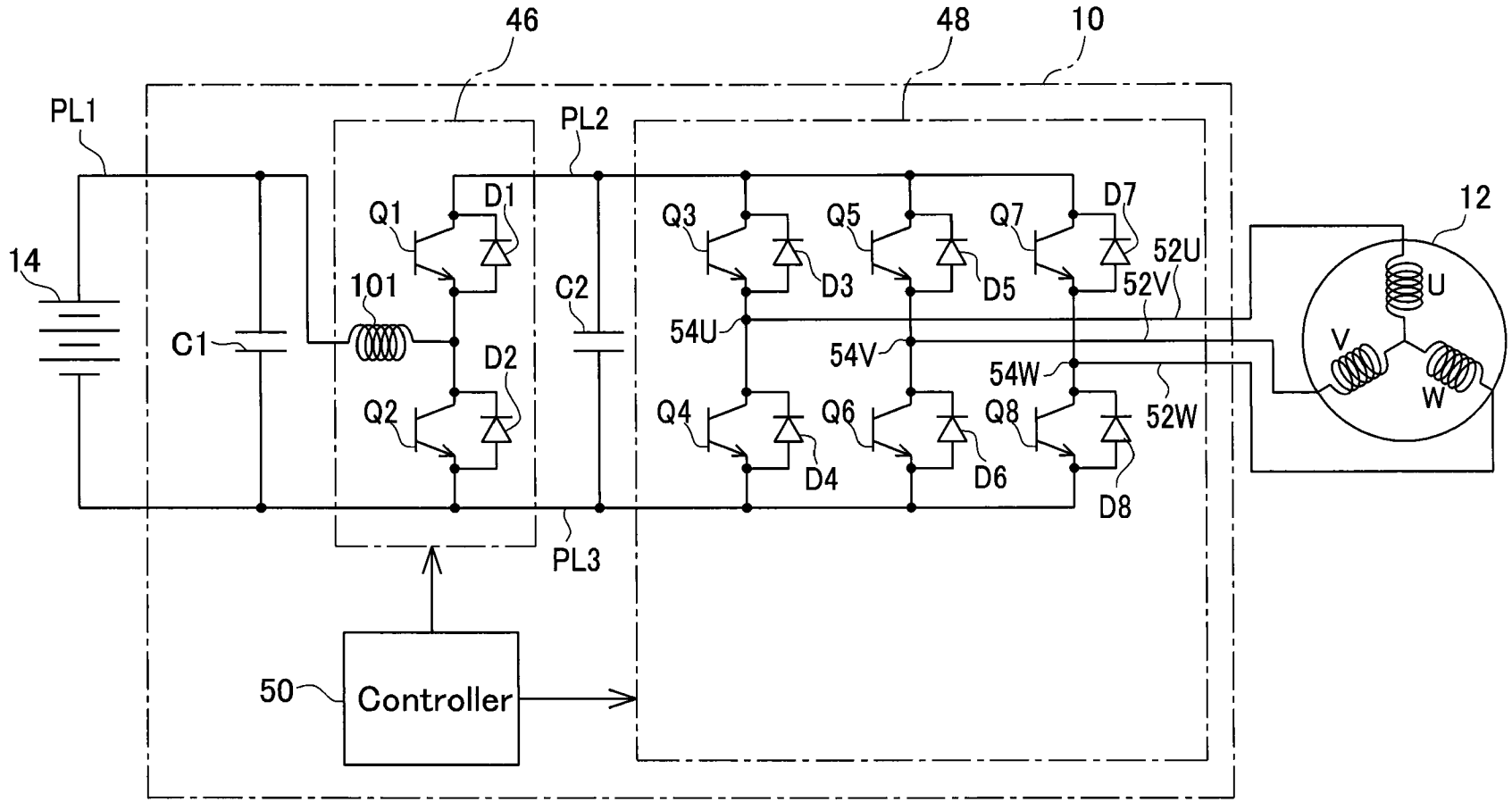
FIG. 2 is a circuit diagram showing major parts of PCU in FIG. 1.

The PCU 10 includes a converter 46, an inverter 48, a controller 50, capacitors C1 and C2, and output lines 52U, 52V, and 52W as shown in FIG. 2.

The converter 46 is connected between the battery 14 and the inverter 48 electrically in parallel with the inverter 48. The inverter 48 is connected to the motor generator 12 via the output lines 52U, 52V, and 52W.

The battery 14 is, for example, a secondary battery such as a nickel metal hydride or lithium ion battery. The battery 14 supplies a direct current to the converter 46 and is charged by the direct current flowing from the converter 46.

The converter 46 is made up of power transistors Q1 and Q2, diodes D1 and D2, and the reactor 101 to be described later in more detail. The power transistors Q1 and Q2 are connected in series between power supply lines PL2 and PL3 and supply control signals from the controller 50 to a base. The diodes D1 and D2 are each connected between collector and emitter terminals of the power transistors Q1 and Q2 so that the current flows from the emitter terminals to the collector terminals of the respective power transistors Q1 and Q2.

The reactor 101 is arranged to have one end connected to a power supply line PL1 that connects to a positive electrode of the battery 14 and the other end connected to a connection point between the power transistors Q1 and Q2.

The converter 46 boosts the DC voltage of the battery 14 by the reactor 101 and supplies the boosted DC voltage to the power supply line PL2. The converter 46 charges the battery 14 with the direct current received from the inverter 48 at a lowered voltage.

The inverter 48 is formed by a U-phase arm 54U, a V-phase arm 54V, and a W-phase arm 54W. The respective phase arms 54U, 54V, and 54W are connected in parallel between the power supply lines PL2 and PL3. The U-phase arm 54U is formed by series-connected power transistors Q3 and Q4, the V-phase arm 54V is formed by series-connected power transistors Q5 and Q6, and the W-phase arm 54W is formed by series-connected power transistors Q7 and Q8. The diodes D3 to D8 are each connected between the collector and emitter terminals of the power transistors Q3 to Q8 so that the current flows from the emitter terminals to the collector terminals of the respective power transistors Q3 to Q8. The connection points between the respective pairs of power transistors Q3 to Q8 at the respective phase arms 54U, 54V, and 54W are connected to the opposite side of the neutral point of the U-phase, V-phase, and W-phase of the motor generator 12, respectively, via the output lines 52U, 52V, and 52W.

The inverter 48 converts a direct current flowing in the power supply line PL2 into an alternating current based on a control signal from the controller 50 and outputs the alternating current to the motor generator 12. The inverter 48 rectifies the alternating current generated by the motor generator 12 and converts the alternating current into a direct current, and supplies the converted direct current to the power supply line PL2.

The capacitor C1 is connected between the power supply lines PL1 and PL3 and smoothes the voltage level of the power supply line PL1. The capacitor C2 is connected between the power supply lines PL2 and PL3 and smoothes the voltage level of the power supply line PL2.

The controller 50 calculates the coil voltages at the U-phase, V-phase, and W-phase of the motor generator 12 based on the rotation angle of a rotor of the motor generator 12, motor torque commands, current values at the U-phase, V-phase, and W-phase of the motor generator 12, and an input voltage of the inverter 48. The controller 50 generates a PWM (Pulse Width Modulation) signal for switching on and off the power transistors Q3 to Q8 based on the calculation results and outputs the signal to the inverter 48.

Also, in order to optimize the input voltage of the inverter 48, the controller 50 calculates the duty ratio between the power transistors Q1 and Q2 based on the motor torque commands mentioned above and the motor rpm, generates a PWM signal for switching on and off the power transistors Q1 and Q2 based on the calculation results, and outputs the signal to the converter 46.

Further, the controller 50 controls the switching operation of the power transistors Q1 to Q8 in the converter 46 and the inverter 48 for converting the alternating current generated by the motor generator 12 into a direct current to charge the battery 14.

In the PCU 10 configured as described above, the converter 46 boosts the voltage of the battery 14 based on the control signal of the controller 50 and applies the boosted voltage to the power supply line PL2. The capacitor C1 smoothes the voltage applied to the power supply line PL2 and the inverter 48 converts the DC voltage smoothed by the capacitor C1 into an AC voltage and outputs the voltage to the motor generator 12.

On the other hand, the inverter 48 converts the AC voltage generated through regeneration using the motor generator 12 into a DC voltage and outputs the voltage to the power supply line PL2. The capacitor C2 smoothes the voltage applied to the power supply line PL2 and the converter 46 charges the battery 14 with the DC voltage smoothed by the capacitor C2 at a lowered voltage level.

[Embodiment 1]

Next, the reactor according to the present embodiment will be described.

<Description of the Structure of the Reactor>

Figure 3:
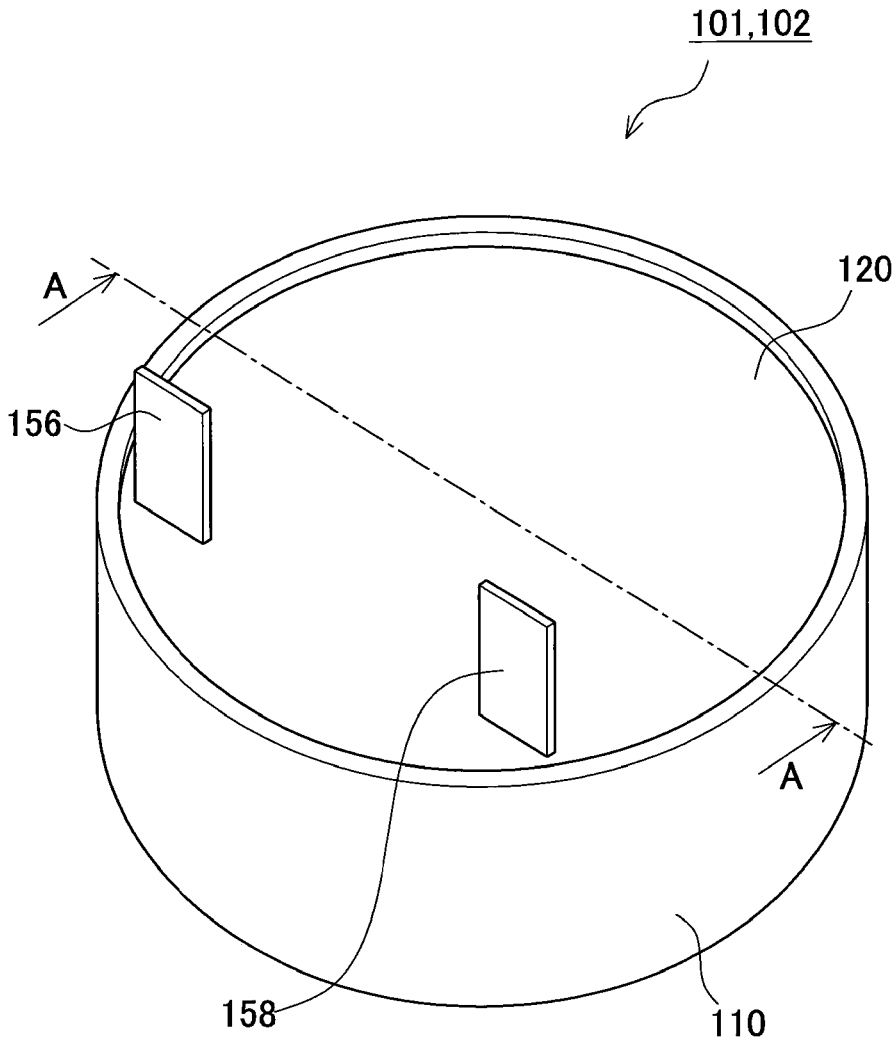
FIG. 3 is an external perspective view of the reactor according to first and second embodiments.
Figure 4:
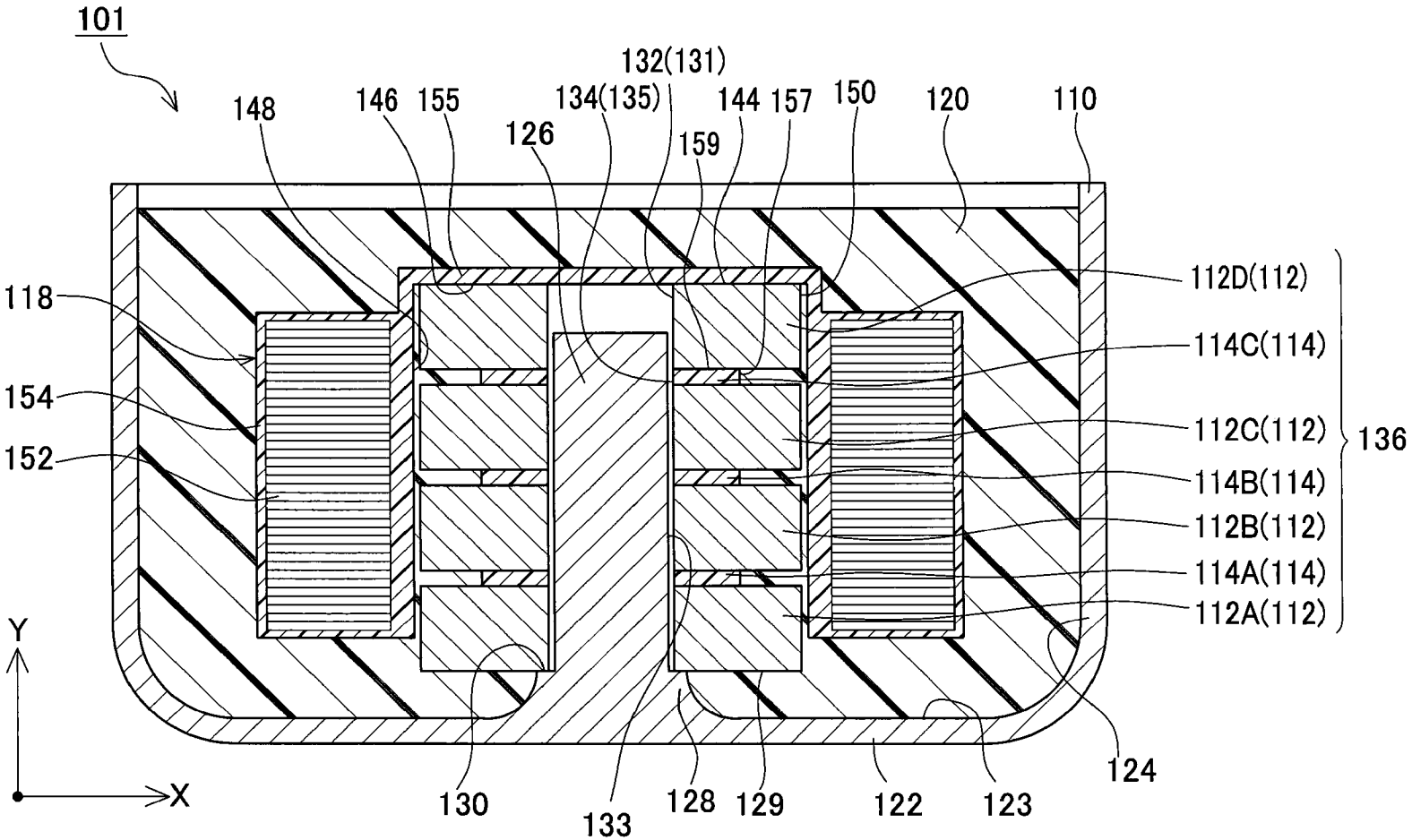
FIG. 4 is a sectional view of the reactor in the first embodiment taken along a line A-A in FIG. 3.
Figure 5:
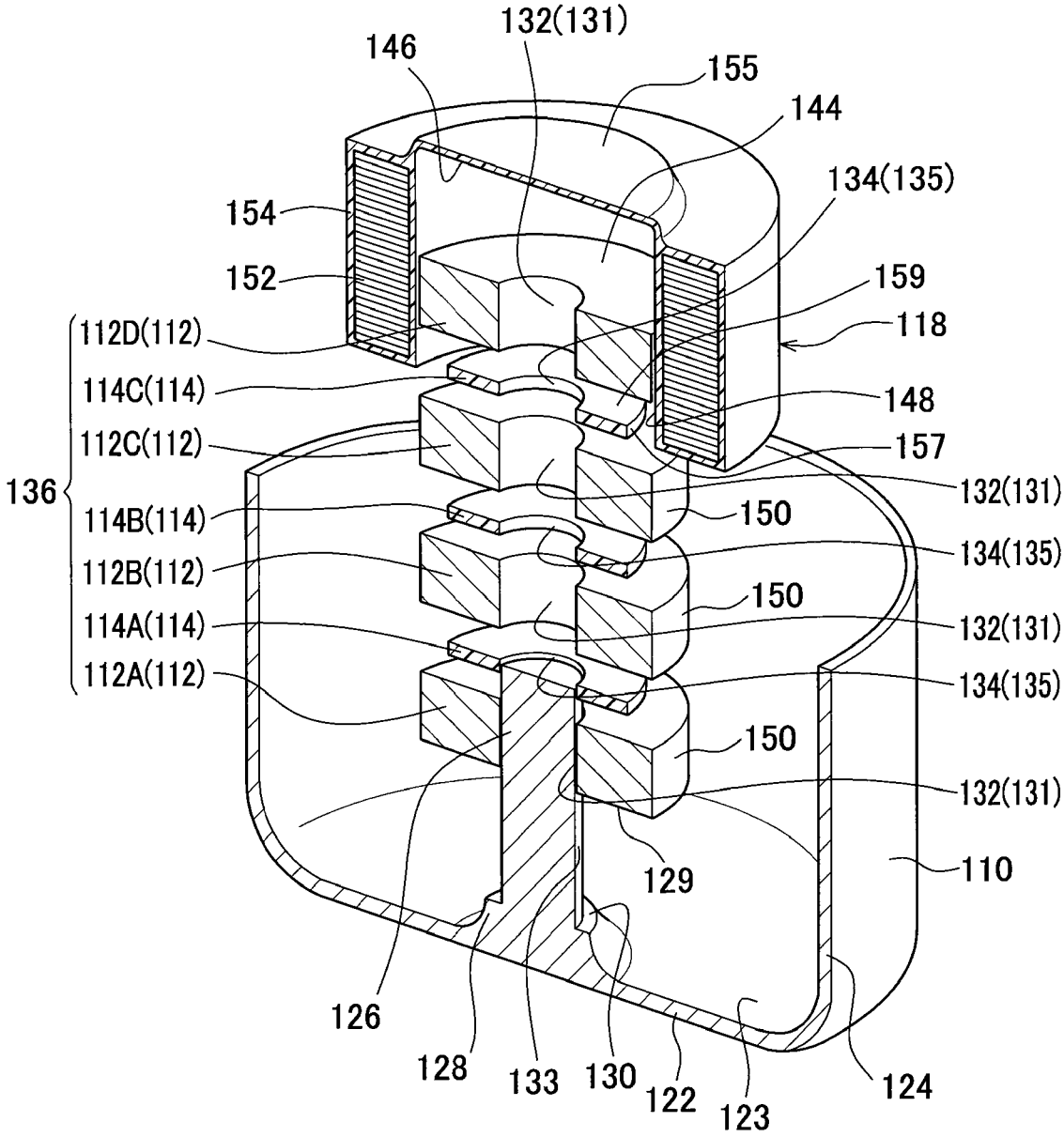
FIG. 5 is an explanatory view explaining how various components configuring the reactor are assembled in a case according to the first embodiment.

FIG. 3 is an external perspective view of the reactor 101 of Embodiment 1. FIG. 4 is a cross sectional view taken along a line A-A of FIG. 3. FIG. 5 is an explanatory view explaining how various components configuring the reactor 101 of this embodiment are assembled into a case 110. Note that, in the following description, a "radial direction" shall refer to the X direction in FIG. 4, while an "axial direction" shall refer to the Y-direction in FIG. 4.

The reactor 102 according to Embodiment 2 to be described later has the same outer shape as the reactor 101 of this embodiment as shown in FIG. 3. As shown in FIGS. 3 and 4, the reactor 101 of this embodiment includes the case 110, pressed powder core members 112, gap plates 114, a coil assembly 118, a resin core 120, and so on.

The case 110 is made by casting from aluminum. The case 110 is formed in an open-end box-like shape with a circular bottom part 122 and a side wall 124 provided extending vertically from a peripheral edge of the bottom part 122. At a central portion in an inner face 123 of the bottom part 122 is provided with a solid cylindrical core shaft 126 via a seat 128. The core shaft 126 is therefore formed integrally with the case 110, with the seat 128 provided at a base portion of the core shaft 126. An upper face 130 of the seat 128, which is the surface on which the core shaft 126 is provided, has a larger diameter than that of the core shaft 126. As shown in FIG. 4, an end face 129 on a lower side in an axial direction (side of the bottom part 122 of the case 110) of a pressed powder core member 112A is in contact with the seat 128.

The pressed powder core member 112 is a high density magnetic composite (HDMC) made by press-forming magnetic powder with a high density, and formed into a circular ring-like shape. The pressed powder core member 112 has a through hole 132 extending in the axial direction radially inside an inner peripheral surface 131 thereof. The pressed powder core member 112 is provided radially outside an outer peripheral surface 133 of the core shaft 126 such that the core shaft 126 is inserted into the through hole 132. The pressed powder core member 112 is sealed with an iron-resin composite that forms the resin core 120. In this embodiment, there are four pressed powder core members 112, which are denoted at 112A to 112D in the drawings. The pressed powder core members 112 are provided such as to be spaced apart a certain distance from each other in the axial direction by means of gap plates 114 interposed between the adjacent pressed powder core members 112. The pressed powder core members 112A to 112D are one example of the "ring-shaped core member" of the present invention.

The gap plate 114 is a plate formed of a non-magnetic material and formed into a circular ring-like shape. The gap plate 114 has a through hole 134 extending in the axial direction radially inside an inner peripheral surface 135 thereof. To give one example, the gap plate 114 may be made of alumina ceramics. In this embodiment, there are three gap plates 114, which are denoted at 114A, 114B, and 114C in the drawings. The inductance of the reactor 101 can be adjusted by adjusting the thickness of the gap plates 114A to 114C. The inductance of the reactor 101 can also be adjusted by adjusting the numbers of the pressed powder core members 112 and the gap plates 114.

The pressed powder core members 112 and the gap plates 114 are provided alternately in the axial direction radially outside the outer peripheral surface 133 of the core shaft 126 such that the core shaft 126 integral with the case 110 is inserted into the through holes 132 of the pressed powder core members 112A to 112D and the through holes 134 of the gap plates 114A to 114C. More specifically, the pressed powder core member 112A, gap plate 114A, pressed powder core member 112B, gap plate 114B, pressed powder core member 112C, gap plate 114C, and pressed powder core member 112D are provided in this order from the bottom part 122 side of the case 110. In this manner, the pressed powder core member 112A located closest to the bottom part 122 of the case 110 is disposed upon the upper face 130 of the seat 128. The plurality of pressed powder core members 112A to 112D are stacked upon one another with the gap plates 114A to 114C interposed in between in this manner to form a tubular center core 136, which is disposed upon the upper face 130 of the seat 128.

The coil assembly 118 is formed in a cylindrical shape and includes an edgewise coil 152, a resin film 154, and a bridge portion 155. The edgewise coil 152 is covered by the resin film 154 except for end portions 156 and 158 that will form electrode terminals. Thus, the edgewise coil 152 is insulated from outside except for the end portions 156 and 158. The resin forming the resin film 154 should preferably be a thermosetting resin having high heat resistance such as an epoxy resin. The coil assembly 118 is sealed with the iron-resin composite forming the resin core 120. This coil assembly 118 is provided radially outside an outer peripheral surface 150 of the pressed powder core members 112A to 112D such that the pressed powder core members 112A to 112D are inserted radially inside the inner peripheral surface 148 of the coil assembly.

The bridge portion 155 is formed to protrude radially inwards from the inner peripheral surface 148 of the coil assembly 118. The bridge portion 155 is formed such as to close an end in the axial direction of the coil assembly 118. The bridge portion 155 is formed integrally with the resin film 154 and made of the same thermosetting resin having high heat resistance (such as epoxy resin) as the resin film 154. The bridge portion 155 is one example of the "protrusion" of the present invention.

The coil assembly 118 formed as described above is provided such as to cover the center core 136 from an end face 144 side in the axial direction of the pressed powder core members 112A to 112D. An inner surface 146 of the bridge portion 155 of the coil assembly 118 is in contact with the end face 144 of the pressed powder core member 112D which is placed uppermost part of the center core 136. This determines the relative positions in the axial direction of the pressed powder core members 112A to 112D, the gap plates 114A to 114C, and the coil assembly 118. The bridge portion 155 of the coil assembly 118 is formed to have the inner surface 146 with a larger diameter than that of the pressed powder core members 112A to 112D, and the inner peripheral surface 148 of the coil assembly 118 is formed to have a larger diameter than that of the pressed powder core members 112A to 112D. Therefore, there is a gap between the inner peripheral surface 148 of the coil assembly 118 and the outer peripheral surface 150 of the pressed powder core members 112A to 112D of the center core 136, this gap being filled with the iron-resin composite.

The coil assembly 118 is provided radially outside the outer peripheral surface 150 of the pressed powder core members 112A to 112D such that the pressed powder core members 112A to 112D are inserted radially inside the inner peripheral surface 148 thereof. Therefore, before the inside of the case 110 is filled with the iron-resin composite, the relative positions in the radial direction of the pressed powder core members 112A to 112D and the coil assembly 118 can be adjusted within the size range of the gap provided between the outer peripheral surface 150 of the pressed powder core members 112A to 112D and the inner peripheral surface 148 of the coil assembly 118. Accordingly, it is easy to adjust the coil assembly 118 and the pressed powder core members 112A to 112D to be disposed coaxial with each other. Here, "the coil assembly 118 and the pressed powder core members 112A to 112D being disposed coaxial with each other" refers to a center axis of the coil assembly 118 and a center axis of the pressed powder core members 112A to 112D being arranged to coincide with each other.

The resin core 120 is formed of the hardened iron-resin composite filling the case 110. The resin core 120 seals the pressed powder core members 112A to 112D, the gap plates 114A to 114C, and the coil assembly 118. The resin core 120 also fills up the gap between the inner peripheral surface 148 of the coil assembly 118 and the outer peripheral surface 150 of the pressed powder core members 112A to 112D. The iron-resin composite should preferably be made of a thermosetting resin having high heat resistance and high heat conductivity such as an epoxy resin in which iron powder is mixed in.

The reactor 101 of this embodiment includes the resin core 120 formed by filling up the iron-resin composite in the case 110 and the pressed powder core members 112A to 112D having a high magnetic permeability at the center core 136. Therefore, the reactor 101 of this embodiment can provide a large inductance despite the small volume of the resin core 120 due to the magnetic properties being improved while the reactor 101 maintains the characteristics that the resin core 120 allows high freedom of outer shape designing. Accordingly, the reactor 101 of this embodiment can have a smaller outer shape.

With the non-magnetic gap plates 114 inserted between adjacent pressed powder core members 112, the distance between the adjacent pressed powder core members 112 can be maintained. Therefore, the magnetic performance is improved, as magnetic flux density saturation is prevented when a large current is applied to the coil.

Also, since the inductance can be readily adjusted by adjusting the thickness or number of the pressed powder core members 112A to 112D and the gap plates 114A to 114C, stable DC superimposition characteristics can be achieved, with the inductance being substantially constant (flat) within the range of current being used, leading to improved performance of the reactor 101.

The bridge portion 155 of the coil assembly 118 is in contact with the end face 144 of the uppermost pressed powder core member 112D of the center core 136. This determines the relative positions in the axial direction of the pressed powder core members 112A to 112D, the gap plates 114A to 114C, and the coil assembly 118. Therefore, there is no need to use a component dedicated to determine the relative positions in the axial direction of the pressed powder core members 112A to 112D, the gap plates 114A to 114C, and the coil assembly 118. The number of components can thereby be reduced, and a reduction in production cost can be achieved. Also, assembly of parts is made easier.

Since the core shaft 126 is integrally formed with the case 110, the pressed powder core members 112A to 112D and the coil assembly 118 can be adjusted in position in the radial direction relative to the case 110.

To give another example, the bridge portion 155 may be formed at a lower end (bottom part 122 side of the case 110) in the axial direction of the coil assembly 118. In this example, the bridge portion 155 is provided with a through hole for allowing the core shaft 126 to pass through and is disposed on the seat 128 with the core shaft 126 inserted in the through hole of the bridge portion 155. The pressed powder core member 112A is arranged on the bridge portion 155 and the pressed powder core members 112B and 112C and the gap plates 114A to 114C are arranged thereon. With this example, the relative positions in the axial direction of the pressed powder core members 112A to 112D, the gap plates 114A to 114C, and the coil assembly 118 are determined.

Moreover, since the pressed powder core members 112A to 112D are entirely sealed with the rigid resin core 120, the pressed powder core members 112A to 112D are protected from corrosion and prevented from cracks.

The center core 136 is formed easily by disposing the pressed powder core members 112A to 112D and the gap plates 114A to 114C radially outside the outer peripheral surface 133 of the core shaft 126 such that the core shaft 126 is inserted into the through holes 132 and 134 of the pressed powder core members 112A to 112D and the gap plates 114A to 114D. Thus productivity of the reactor 101 is improved.

With the reactor 101 of this embodiment, the volume of the resin core 120 is reduced by the volumes of the pressed powder core members 112A to 112D, so that the time required for filling and setting the iron-resin composite to form the resin core 120 is shortened. Also, the amount of use of the iron-resin composite can be reduced, so that the material cost can be reduced. Accordingly the production cost can be reduced.

In another possible example, the core shaft 126 may be formed hollow with its upper face (upper end face in FIG. 4) closed. With this example, a cooling fluid can be supplied to the hollow part of the core shaft 126, which will lead to better cooling performance.

In yet another example, the bridge portion 155 may be provided with a through hole for allowing the core shaft 126 to enter and the core shaft 126 may be extended such that its upper end (upper end portion in FIG. 4) protrudes beyond the upper end (upper end portion in FIG. 4) of the case 110 with an axially extending through hole provided in the core shaft 126. With this example, a cooling fluid can be supplied through the through hole of the core shaft 126, which will lead to better cooling performance.

<Description of the Reactor Manufacturing Method>

Figure 6:
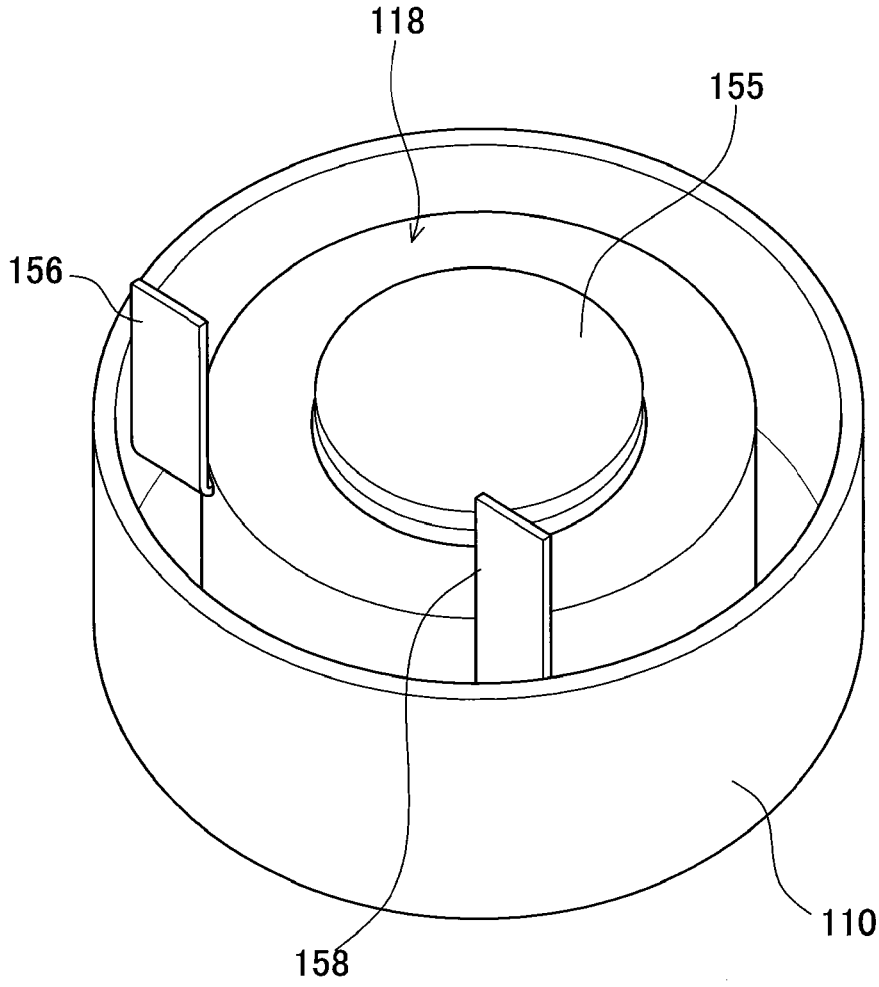
FIG. 6 is an explanatory view showing a state after various components configuring the reactor are assembled in the case and before the case is filled with an iron-resin composite.

FIG. 5 is an explanatory view explaining how various components configuring the reactor 101 of this embodiment are assembled into the case 110, as mentioned above. FIG. 6 is an explanatory view showing a state after various components forming the reactor 101 of this embodiment have been assembled into the case 110 and before the case is filled with the iron-resin composite.

The reactor 101 of this embodiment is manufactured as follows. First, as shown in FIG. 5, the pressed powder core members 112A to 112D and the gap plates 114A to 114C are alternately disposed with the core shaft 126 integral with the case 110 being inserted into the through holes 132 and 134 of the pressed powder core members 112A to 112D and the gap plates 114A to 114C. More specifically, the pressed powder core member 112A, gap plate 114A, pressed powder core member 112B, gap plate 114B, pressed powder core member 112C, gap plate 114C, and pressed powder core member 112D are disposed in this order from a side of the bottom part 122 of the case 110.

Thus the cylindrical center core 136 is formed by the plurality of pressed powder core members 112A to 112D stacked upon one another with the gap plates 114A to 114C interposed in between.

At this time, the center core 136 is disposed upon the upper face 130 of the seat 128. More particularly, the pressed powder core member 112A, which is the one located closest to the bottom part 122 of the case 110, of the pressed powder core members 112A to 112D forming the center core 136 is disposed upon the upper face 130 of the seat 128, so that the end face 144 of the pressed powder core member 112A comes into contact with the upper face 130 of the seat 128. The pressed powder core member 112A located closest to the bottom part 122 of the case 110 is formed to have an inner peripheral surface 131 with an inside diameter that is smaller than the outside diameter of the upper face 130 of the seat 128. Thereby the pressed powder core member 112A can be reliably placed on the upper face 130 of the seat 128.

This arrangement in which the pressed powder core member 112A, which is the one located closest to the bottom part 122 of the case 110 of the pressed powder core members 112A to 112D forming the center core 136, is disposed upon the upper face 130 of the seat 128, determines the positions in the axial direction of the pressed powder core members 112A to 112D and the gap plates 114A to 114C forming the center core 136. Also, the relative positions in the radial direction of the case 110 and the pressed powder core members 112A to 112D can be adjusted within the size range of the gap between the outer peripheral surface 133 of the core shaft 126 and the inner peripheral surface 131 of the pressed powder core members 112A to 112D. Also, the relative positions in the radial direction of the case 110 and the gap plates 114A to 114C can be adjusted within the size range of the gap between the outer peripheral surface 133 of the core shaft 126 and the inner peripheral surface 135 of the gap plates 114A to 114C. Using the core shaft 126 and the seat 128 integral with the case 110 in this manner enables setting the pressed powder core members 112A to 112D and the gap plates 114A to 114C at predetermined positions without increasing the number of components.

Next, as shown in FIG. 5, the coil assembly 118 is placed on top of the center core 136 such that the coil assembly 118 receives the center core 136 radially inside the inner peripheral surface 148 thereof while the gap is kept between the inner peripheral surface 148 of the coil assembly 118 and the outer peripheral surface 150 of the pressed powder core members 112A to 112D. At this time, the bridge portion 155 of the coil assembly 118 is brought into contact with the end face 144 of the uppermost pressed powder core member 112D of the center core 136. This determines the relative positions in the axial direction of the pressed powder core members 112A to 112D, the gap plates 114A to 114C, and the coil assembly 118.

Also, the relative positions in the radial direction of the pressed powder core members 112A to 112D and the coil assembly 118 can be adjusted within the size range of the gap provided between the outer peripheral surface 150 of the pressed powder core members 112A to 112D and the inner peripheral surface 148 of the coil assembly 118.

Next, the iron-resin composite in a molten state is poured into the case 110 and the case 110 is placed in a heating furnace (not shown) and heated at a predetermined temperature for a predetermined period of time to set the iron-resin composite to form the resin core 120. Thereby, the center core 136 and the coil assembly 118 are sealed with the resin core 120.

The reactor 101 is manufactured as described above.

According to the method of manufacturing the reactor 101 of this embodiment, the bridge portion 155 of the coil assembly 118 is brought into contact with the end face 144 in the axial direction of the pressed powder core member 112D, whereby the relative positions in the axial direction of the pressed powder core members 112A to 112D, the gap plates 114A to 114C, and the coil assembly 118 are determined. Therefore, there is no need to use a component dedicated to determine the relative positions in the axial direction of the pressed powder core members 112A to 112D, the gap plates 114A to 114C, and the coil assembly 118. Accordingly, the number of components can be reduced and a reduction in production cost can be achieved.

Since the bridge portion 155 protruding radially inwards from the inner peripheral surface 148 of the coil assembly 118 is in contact with the end face 144 of the pressed powder core member 112D, the weight of the coil assembly 118 acts on the pressed powder core members 112A to 112D. This prevents the pressed powder core members 112A to 112D from lifting up or moving during a period of time when the case 110 is filled with the iron-resin composite and the iron-resin composite is set. Thus productivity of the reactor 101 is improved.

Moreover, the iron-resin composite in a molten state poured into the case 110 after the various components have been placed also takes a role as the adhesive for the various parts, so that a step of bonding the pressed powder core members 112A to 112D and the gap plates 114A to 114C together with adhesive can be omitted.

Figure 7:
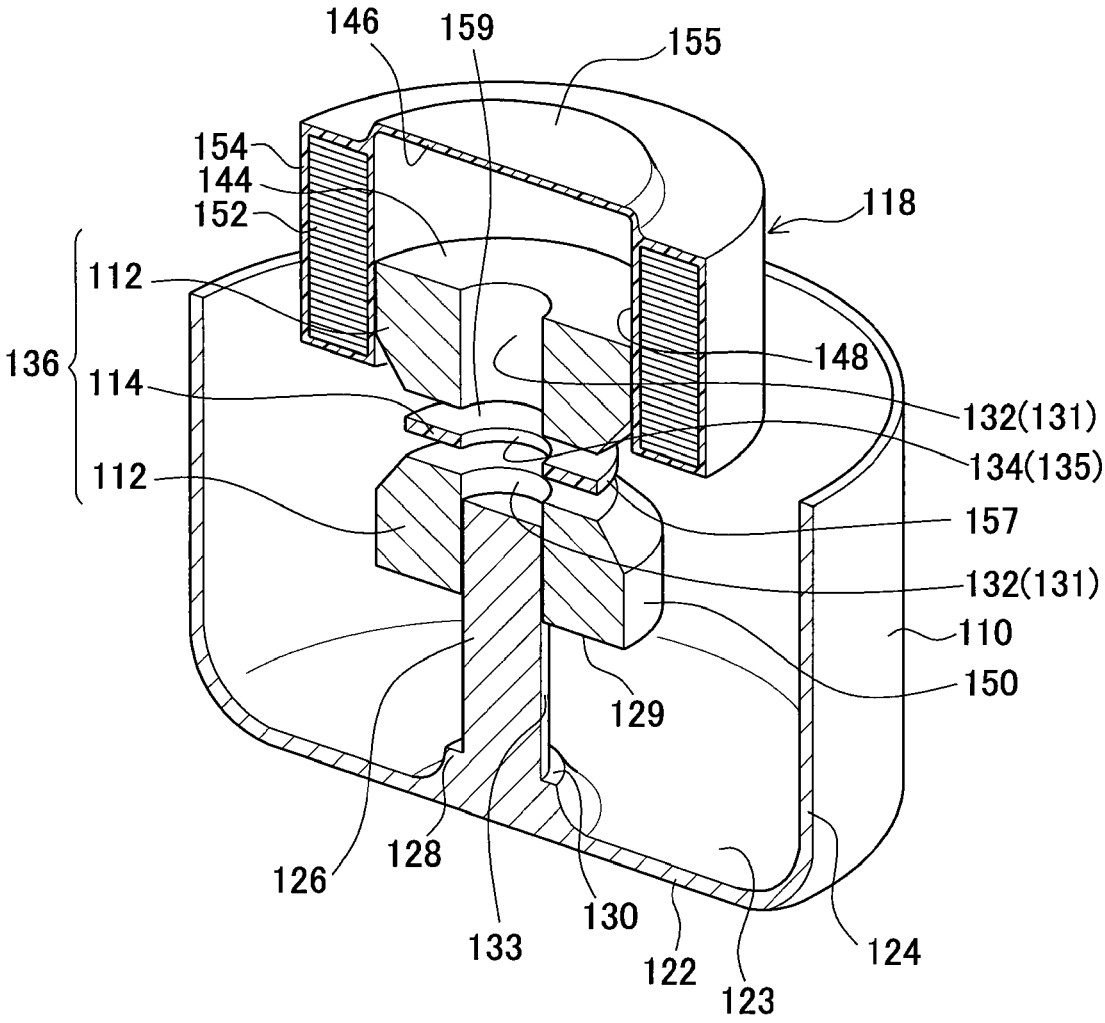
FIG. 7 is a view showing another example in which the number of pressed powder core members and gap plates are changed.

The numbers of the pressed powder core members 112 and the gap plates 114 are not limited to particular ones. There could be an embodiment where two pressed powder core members 112 and one gap plate 114 are provided, as shown in FIG. 7.

In another possible example, the bridge portion 155 may have an opening. This will allow the iron-resin composite in the molten state to flow in from the opening, whereby the pressed powder core members 112A to 112D and the gap plates 114A to 114C can be reliably bonded to each other.

In yet another example, an end face 159 in the axial direction of the gap plates 114A to 114C may be formed with radial grooves extending between the positions of the inner peripheral surface 135 and the outer peripheral surface 157. This will allow even more reliable bonding of the pressed powder core members 112A to 112D with the gap plates 114A to 114C by means of the iron-resin composite flowing in through the grooves and setting between the pressed powder core members 112A to 112D and the gap plates 114A to 114C.

[Embodiment 2]

Figure 8:
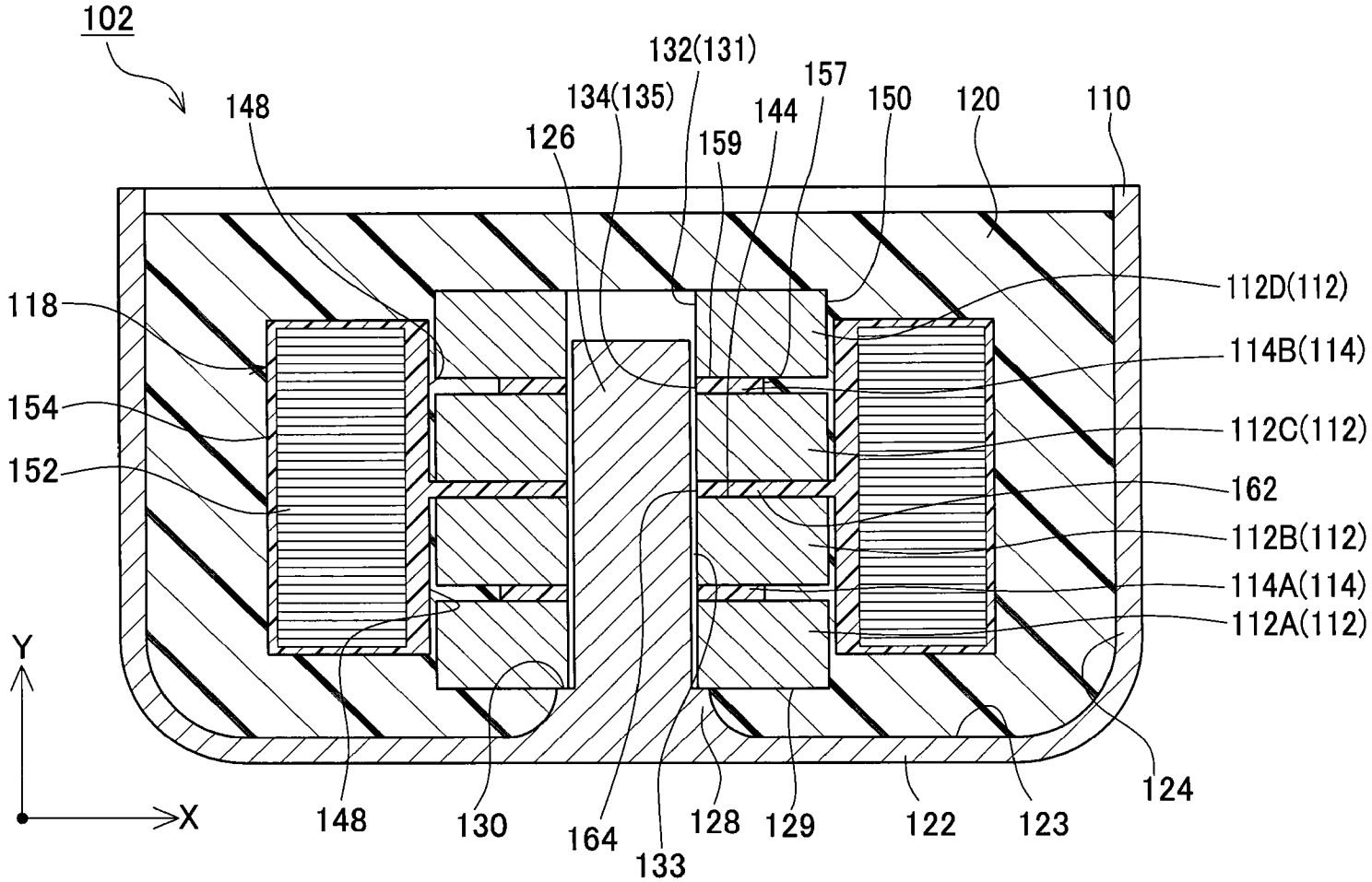
FIG. 8 is a sectional view of the reactor in a second embodiment taken along a line A-A in FIG. 3.
Figure 9:
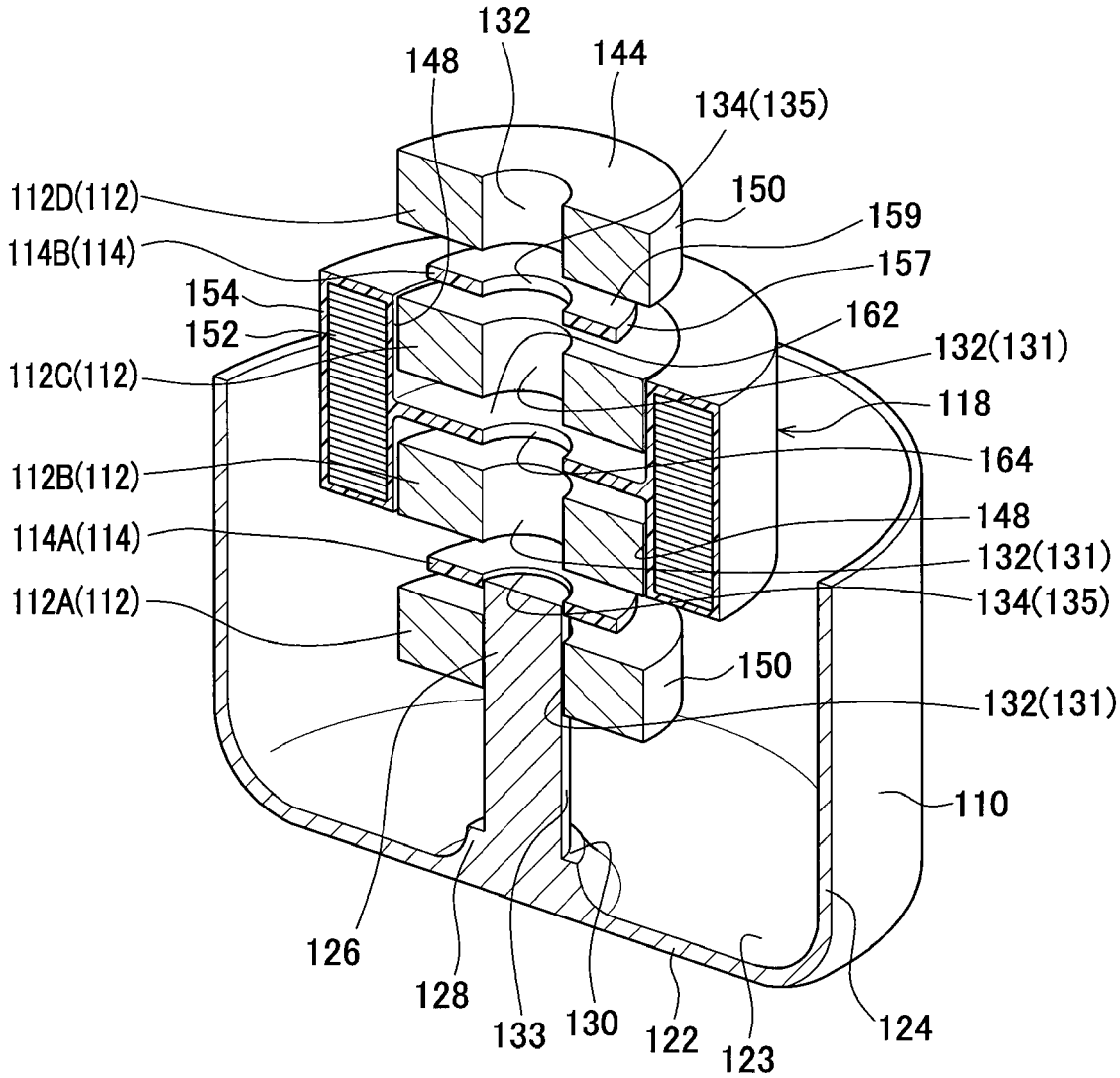
FIG. 9 is an explanatory view showing how various components configuring the reactor are assembled in the case in the second embodiment.

The reactor 102 according to Embodiment 2 has the same outer shape as that of Embodiment 1 as mentioned above and shown in FIG. 3. FIG. 8 is a cross sectional view of the reactor 102 of Embodiment 2 taken along a line A-A in FIG. 3. FIG. 9 is an explanatory view explaining how various components configuring the reactor 102 of Embodiment 2 are assembled into the case 110. Note that, in the following description, a "radial direction" shall refer to the X direction in FIG. 8 while an "axial direction" shall refer to the Y-direction in FIG. 8. Same or similar constituent elements as Embodiment 1 will be given the same reference numerals and not described again, and different points will be mainly explained in the following description.

<Description of the Structure of the Reactor>

Unlike the reactor 101 of Embodiment 1, the coil assembly 118 in the reactor 102 of Embodiment 2 does not include the bridge portion 155 but instead includes a partition 162 in a central portion in the axial direction of the coil assembly 118. The partition 162 is formed to protrude radially inwards from the inner peripheral surface 148 and formed in an annular shape. The partition 162 is formed, on the inner peripheral side thereof, with a through hole 164 extending in the axial direction of the coil assembly 118. The partition 162 is arranged on the end face 144 of the second pressed powder core member 112B counted from the bottom part 122 side of the case 110. Thus the partition 162 is provided between the pressed powder core members 112B and 112C adjacent to each other. The partition 162 is one example of the "protrusion" of the present invention.

Figure 10:
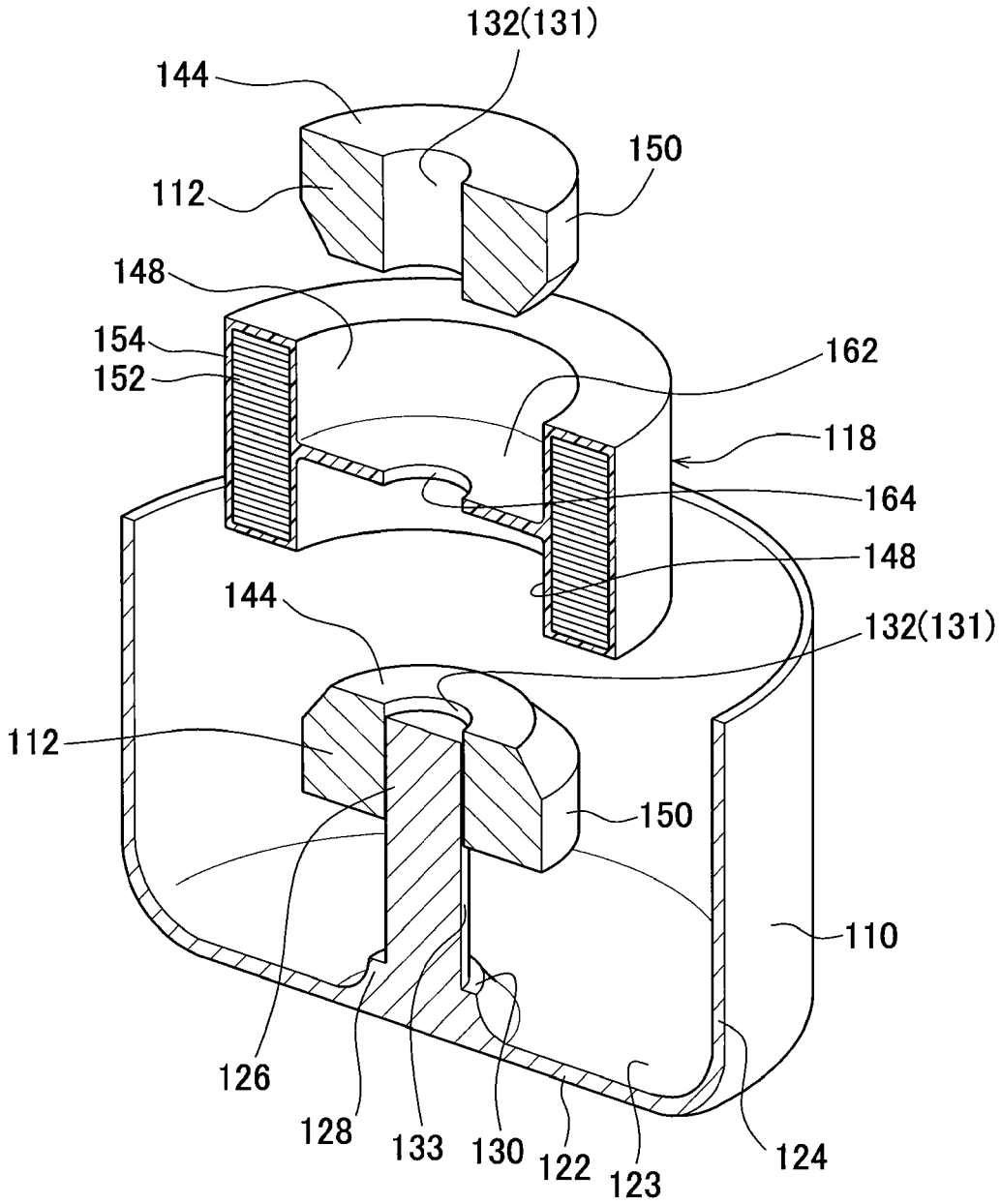
FIG. 10 is an explanatory view showing another example in which the reactor comprising two pressed powder core members.

With the reactor 102 of Embodiment 2, the inductance can be adjusted by adjusting the thickness of the partition 162. The partition 162 of the coil assembly 118 thus has the same function as the gap plates 114. Therefore, the number of gap plates 114 can be reduced by one, leading to reduction of the number of components, whereby the production cost can be reduced. In an embodiment where there are two pressed powder core members 112 as shown in FIG. 10, the gap plates 114 can be omitted.

<Description of the Reactor Manufacturing Method>

The reactor 102 of this embodiment is manufactured as follows. First, the pressed powder core member 112A is disposed on the seat 128 of the core shaft 126 with the core shaft 126 being inserted into the through hole 132 of the pressed powder core member 112A.

Next, the gap plate 114A is disposed on the pressed powder core member 112A with the core shaft 126 inserted into the through hole 134 of the gap plate 114A.

Next, the pressed powder core member 112B is disposed on the gap plate 114A with the core shaft 126 inserted into the through hole 132 of the pressed powder core member 112B.

After that, the partition 162 is arranged on the pressed powder core member 112B with the core shaft 126 inserted into the through hole 164 of the partition 162 such that the partition 162 makes contact with the end face 144 of the pressed powder core member 112B.

Subsequently, the pressed powder core member 112C is disposed on the partition 162 with the core shaft 126 being inserted into the through hole 132 of the pressed powder core member 112C.

Then, the gap plate 114B is disposed on the pressed powder core member 112C with the core shaft 126 inserted into the through hole 134 of the gap plate 114B.

Next, the pressed powder core member 112D is set on the gap plate 114B with the core shaft 126 inserted into the through hole 132 of the pressed powder core member 112D.

The plurality of pressed powder core members 112A to 112D are thus stacked upon one another with the gap plates 114A and 114B and the partition 162 interposed therebetween. A gap is provided between the inner peripheral surface 148 of the coil assembly 118 and the outer peripheral surface 150 of the pressed powder core members 112A to 112D.

The iron-resin composite in a molten state is then poured into the case 110 and the case 110 is placed in a heating furnace (not shown) and heated at a predetermined temperature for a predetermined period of time to set the iron-resin composite to form the resin core 120. Thereby, the pressed powder core members 112A to 112D, the gap plates 114A and 114B, and the coil assembly 118 are sealed with the resin core 120. The reactor 102 is manufactured as described above.

According to the method of manufacturing the reactor 102 of this embodiment, the partition 162 of the coil assembly 118 is brought into contact with the end face 144 of the pressed powder core member 112B, whereby the relative positions in the axial direction of the pressed powder core members 112A and 112B, the gap plate 114A, and the coil assembly 118 are determined. Since the pressed powder core member 112C is disposed on the partition 162, the gap plate 114B is placed upon the pressed powder core member 112C, and further the pressed powder core member 112D is placed upon the gap plate 114B, the relative positions in the axial direction of the pressed powder core members 112C and 112D, the gap plate 114B, and the coil assembly 118 are determined. Therefore, there is no need to use a component dedicated to determine the relative positions in the axial direction of the pressed powder core members 112A to 112D, the gap plates 114A and 114B, and the coil assembly 118. Accordingly, the number of components can be reduced and a reduction in production cost can be achieved.

Since the partition 162 of the coil assembly 118 is brought into contact with the end face 144 of the pressed powder core member 112B, the weight of the coil assembly 118 acts on the pressed powder core members 112A and 112B. This prevents the pressed powder core members 112A and 112B from lifting up or moving during a period of time when the case 110 is filled with the iron-resin composite and the iron-resin composite is set. Thus productivity of the reactor 102 is improved.

The pressed powder core members 112C and 112D should preferably be secured using jigs during the filling of the case 110 with the iron-resin composite and during the setting of the iron-resin composite.

The partition 162 of the coil assembly 118 is provided between the pressed powder core members 112B and 112C. This maintains a certain distance between the pressed powder core members 112B and 112C, allowing prevention of magnetic flux density saturation when a large current is applied to the coil, and therefore the magnetic performance is improved. As the partition 162 exhibits the same function as the gap plates 114, the number of gap plates 114 can be reduced by one. Accordingly, the number of components can be reduced, and a reduction in production cost can be achieved. Also, assembly of parts is made easier.

While one example is shown in FIG. 8 in which the partition 162 is arranged on the second pressed powder core member 112B counted from the bottom part 122 side of the case 110, the invention is not limited to this arrangement. Other arrangements are possible, for example, where the partition 162 may be arranged on the first pressed powder core member 112A or the third pressed powder core member 112C counted from the bottom part 122 side of the case 110.

[Embodiment 3]

Figure 11:
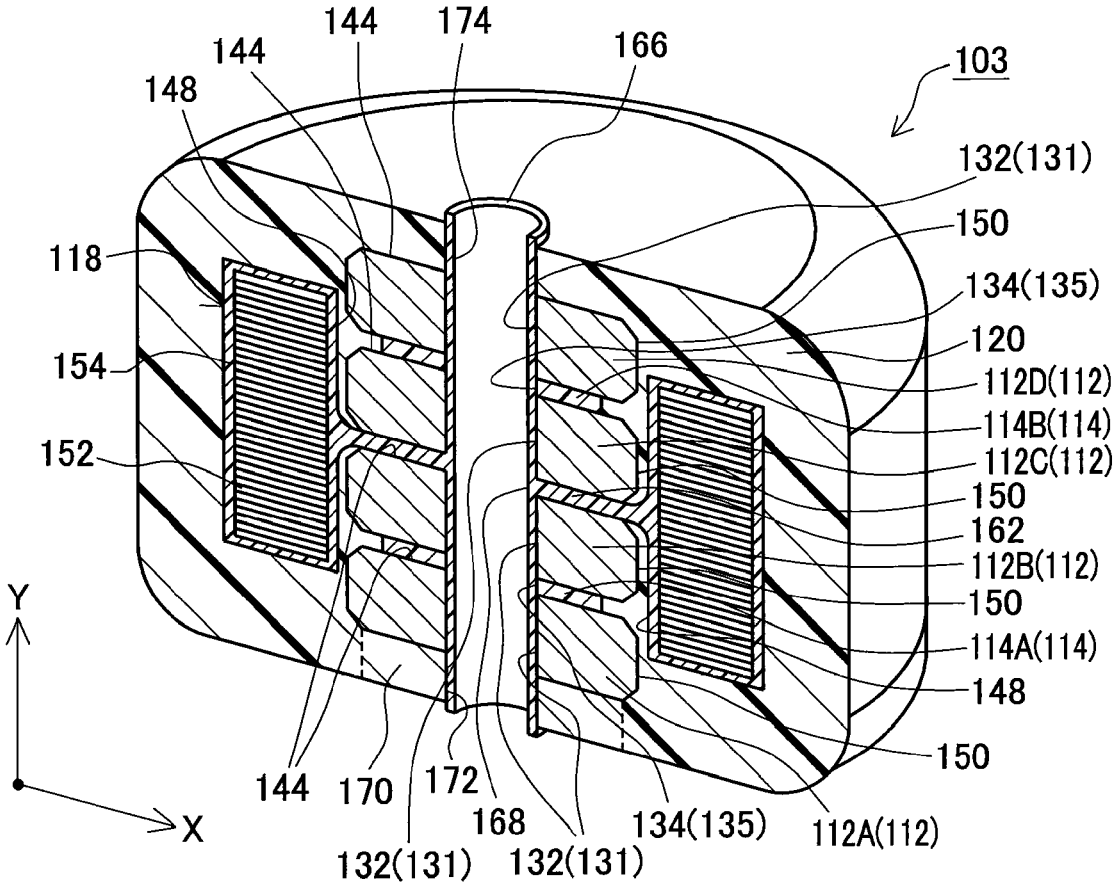
FIG. 11 is a perspective view including a partial sectional view of a reactor in a third embodiment.
Figure 12:
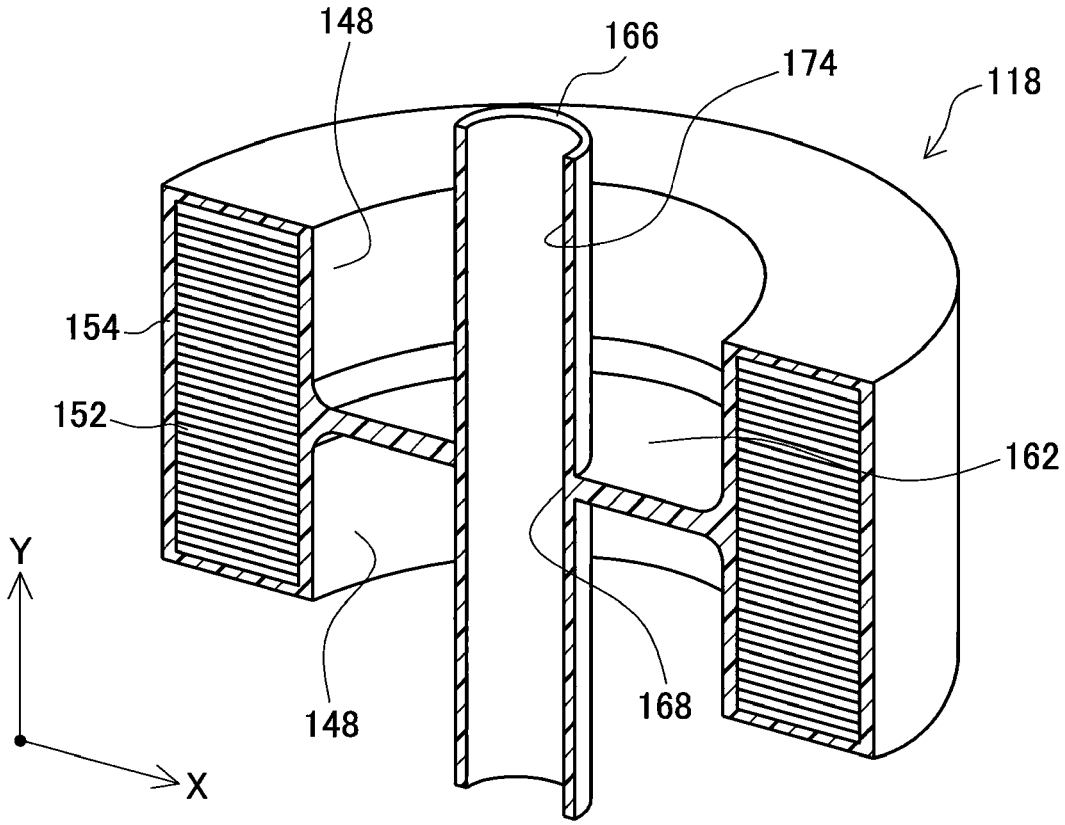
FIG. 12 is a perspective view including a partial sectional view of a coil assembly configuring the reactor in the third embodiment.

FIG. 11 is a perspective view of the reactor 103 of Embodiment 3 including a partial sectional view. FIG. 12 is a perspective view of the coil assembly 118 including a partial sectional view. Note that, in the following description, a "radial direction" shall refer to the X direction in FIGS. 11 and 12 while an "axial direction" shall refer to the Y-direction in FIGS. 11 and 12. Same or similar constituent elements as Embodiment 2 will be given the same reference numerals and not described again, and different points will be mainly explained in the following description.

Unlike the reactor 102 of Embodiment 2, the reactor 103 of Embodiment 3 does not include the case 110. While the reactor does not include the core shaft 126 integral with the case 110, a core shaft 166 is formed integrally with the partition 162 of the coil assembly 118 as shown in FIGS. 11 and 12. More specifically, the core shaft 166 is formed to extend in the axial direction from an inner peripheral surface 168 of the partition 162 of the coil assembly 118. This core shaft 166 is formed in a hollow cylindrical shape.

With the reactor 103 of Embodiment 3, since the core shaft 166 is hollow, a cooling fluid (such as ATF) can be supplied to flow inside the core shaft 166. Therefore, heat generated in the edgewise coil 152 of the coil assembly 118 is transferred to the core shaft 166 via the partition 162, after which it is absorbed in the cooling fluid and discharged to the outside. The reactor 103 can be cooled in this manner.

The core shaft 166 is formed integrally with the partition 162. This configuration makes the component such as the case 110 having the core shaft 126 unnecessary, whereby the production cost can be reduced. Also, the relative positions of the core shaft 166 and the coil assembly 118 are determined in both axial and radial directions.

The core shaft 166 may be formed to be solid.

<Description of the Reactor Manufacturing Method>

The reactor 103 of this embodiment is manufactured as follows. First, a ring-like resin member 170 made of the iron-resin composite is prepared. The resin member 170 is then placed on a bottom of a mold (not shown) such that a post formed inside the mold (hereinafter, "the mold post") is inserted into a through hole 172 of the resin member 170.

Next, the pressed powder core member 112A is disposed on the resin member 170 with the mold post being inserted into the through hole 132 of the pressed powder core member 112A.

Next, the gap plate 114A is disposed on the pressed powder core member 112A with the mold post inserted into the through hole 134 of the gap plate 114A.

The pressed powder core member 112B is then disposed on the gap plate 114A with the mold post inserted into the through hole 132 of the pressed powder core member 112B.

After that, the partition 162 of the coil assembly 118 is placed on the end face 144 of the pressed powder core member 112B, with the mold post being inserted into the hollow portion provided radially inside an inner peripheral surface 174 of the core shaft 166 of the coil assembly 118, and with the core shaft 166 of the coil assembly 118 inserted into the through holes 132 and 134 of the pressed powder core members 112A and 112B and the gap plate 114A. The partition 162 is thus brought into contact with the end face 144 of the pressed powder core member 112B.

Subsequently, the pressed powder core member 112C is disposed on the partition 162 with the core shaft 166 being inserted into the through hole 132 of the pressed powder core member 112C.

Next, the gap plate 114B is disposed on the pressed powder core member 112C with the core shaft 166 inserted into the through hole 134 of the gap plate 114B.

Next, the pressed powder core member 112D is disposed on the gap plate 114B with the core shaft 166 inserted into the through hole 132 of the pressed powder core member 112D.

The iron-resin composite in a molten state is then poured into the mold and the mold is placed in a heating furnace (not shown) and heated at a predetermined temperature for a predetermined period of time to set the iron-resin composite to form the resin core 120. Thereby, the pressed powder core members 112A to 112D, the gap plates 114A and 114B, and the coil assembly 118 are sealed with the resin core 120. After that, the reactor 103 is removed from the mold. The reactor 103 is manufactured as described above.

According to the method of manufacturing the reactor 103 of this embodiment, the resin member 170 is disposed on the bottom of the mold and the pressed powder core members 112A to 112D, the gap plates 114A and 114B, and the partition 162 of the coil assembly 118 are placed upon this resin member 170, so that the axial positions of the pressed powder core members 112A to 112D, the gap plates 114A and 114B, and the coil assembly 118 are determined.

In another possible example, the partition 162 may be formed at one end in the axial direction (lower end in FIG. 12) of the coil assembly 118 while the partition 162 is arranged on the bottom of the mold, the resin member 170 is placed on the partition 162, and the pressed powder core members 112A to 112D and the gap plates 114A to 114C are arranged on this resin member 170. With this example, the axial positions of the pressed powder core members 112A to 112D, the gap plates 114A to 114C, and the coil assembly 118 are determined.

The above mentioned embodiments are merely examples, not limiting the invention. The present invention may be embodied in other specific forms without departing from the essential characteristics thereof.

The plurality of pressed core members 112 are provided in the above embodiments. Alternately, a reactor provided with a single pressed core member 112 may be adopted.

Reference Signs List

1 Drive control system
10 PCU
12 Motor generator
14 Battery
101 Reactor
102 Reactor
103 Reactor
110 Case
112 Pressed powder core member
114 Gap plate
118 Coil assembly
120 Resin core
126 Core shaft
132 Through hole
134 Through hole
136 Center core
148 Inner peripheral surface
155 Bridge portion
162 Partition
164 Through hole
166 Core shaft
C1 Capacitor
C2 Capacitor
Q1~Q8 Power transistor
D1~D4 Diode
PL1~PL3 Power supply line

The invention claimed is:

1. A reactor including a cylindrical coil assembly formed to have a coil covered with resin, an iron-resin composite containing iron powder sealing the coil assembly, wherein the reactor comprises a core shaft and one or a plurality of ring-shaped core members, the ring-shaped core member or members are provided outside an outer peripheral surface of the core shaft such that the core shaft is inserted inside an inner peripheral surface of the ring-shaped core member or members, the coil assembly is provided outside an outer peripheral surface of the ring-shaped core member or members such that the ring-shaped core member or members are inserted inside an inner peripheral surface of the coil assembly, and the coil assembly includes a protrusion protruding inwards from the inner peripheral surface and being in contact with an end face in an axial direction of the ring-shaped core member or members.

2. The reactor according to claim 1 further including a non-magnetic ring-shaped gap plate, wherein the gap plate is provided between adjacent ones of the ring-shaped core members.

3. The reactor according to claim 1, wherein the protrusion is provided between adjacent ones of the ring-shaped core members.

4. The reactor according to claim 1, wherein the reactor includes an open-end case having an end face and a side wall provided extending vertically from a peripheral edge of the end face, and the core shaft is formed integrally with the case on the inner side of the end face.

5. The reactor according to claim 1, wherein the core shaft is formed integrally with the protrusion.

6. The reactor according to claim 1, wherein the protrusion is formed at an end portion in an axial direction of the coil assembly.

7. The reactor according to claim 1, wherein the core shaft is hollow.

8. The reactor according to claim 2, wherein the protrusion is provided between adjacent ones of the ring-shaped core members.

9. The reactor according to claim 2, wherein the reactor includes an open-end case having an end face and a side wall provided extending vertically from a peripheral edge of the end face, and the core shaft is formed integrally with the case on the inner side of the end face.

10. The reactor according to claim 3, wherein the reactor includes an open-end case having an end face and a side wall provided extending vertically from a peripheral edge of the end face, and the core shaft is formed integrally with the case on the inner side of the end face.

11. The reactor according to claim 2, wherein the core shaft is formed integrally with the protrusion.

12. The reactor according to claim 3, wherein the core shaft is formed integrally with the protrusion.

13. The reactor according to claim 2, wherein the protrusion is formed at an end portion in an axial direction of the coil assembly.

14. The reactor according to claim 3, wherein the protrusion is formed at an end portion in an axial direction of the coil assembly.

15. The reactor according to claim 4, wherein the protrusion is formed at an end portion in an axial direction of the coil assembly.

16. The reactor according to claim 5, wherein the protrusion is formed at an end portion in an axial direction of the coil assembly.

17. The reactor according to claim 2, wherein the core shaft is hollow.

18. The reactor according to claim 3, wherein the core shaft is hollow.

19. The reactor according to claim 4, wherein the core shaft is hollow.

20. A method of manufacturing a reactor including a cylindrical coil assembly formed to have a coil covered with resin, an iron-resin composite containing iron powder sealing the coil assembly, wherein the reactor comprises a core shaft and one or a plurality of ring-shaped core member or members, the method includes the steps of:

placing the ring-shaped core member or members outside an outer peripheral surface of the core shaft such that the core shaft is inserted inside an inner peripheral surface of the ring-shaped core member or members;

placing the coil assembly outside an outer peripheral surface of the ring-shaped core member or members such that the ring-shaped core member or members are inserted inside an inner peripheral surface of the coil assembly; and bringing a protrusion protruding inwards from the inner peripheral surface of the coil assembly into contact with an end face in an axial direction of the ring-shaped core member or members.

* * * * *